US005408791A

United States Patent [19]

Marie

[11] Patent Number: 5,408,791

[45] Date of Patent: Apr. 25, 1995

[54] APPARATUS FOR PORTION PACKING OF LUMPY GOODS

[75] Inventor: Rudolf Marie, Hanover, Germany

[73] Assignee: Profi Glas- und Gebäudereinigung, Handels GmbH, Wittenburg, Germany

[21] Appl. No.: 156,502

[22] Filed: Nov. 23, 1993

[30] Foreign Application Priority Data

Nov. 25, 1992 [DE] Germany ..... 42 39 477.5

[51] Int. Cl.[6] ..... B65B 61/26; B65B 9/15

[52] U.S. Cl. ..... 53/131.2; 53/567; 53/576

[58] Field of Search ..... 53/567, 550, 552, 551, 53/576, 530, 527, 248, 502, 131.2

[56] References Cited

U.S. PATENT DOCUMENTS

| | | | |
|---|---|---|---|
| 3,553,924 | 1/1971 | Bonami | 53/21 |
| 3,965,642 | 6/1976 | Hills | 53/550 |
| 3,996,721 | 12/1976 | Mercer | 53/567 |
| 4,009,551 | 3/1977 | Greenawalt | 53/451 |
| 4,107,903 | 8/1978 | Wickersheim | 53/138 |
| 4,516,379 | 5/1985 | Iain | 53/552 |
| 4,722,373 | 2/1988 | Roovers | 53/248 |

FOREIGN PATENT DOCUMENTS

| | | | |
|---|---|---|---|
| 1195302 | 10/1985 | Canada | 53/567 |
| 3102552 | 10/1982 | Germany | 53/520 |
| 3110215 | 9/1992 | Germany | 53/567 |
| 42906 | 2/1993 | Japan | 53/248 |

*Primary Examiner*—Daniel C. Crane

*Attorney, Agent, or Firm*—Panitch, Schwarze, Jacobs & Nadel

[57] ABSTRACT

The invention involves an apparatus (1) for the portion packing of lumpy goods, in particular of impact-sensitive fruit and vegetables. The apparatus preferably includes two conveyor pipes (2, 3) with one inlet and one outlet each in their end regions, and with a conveyor device (11) that exhibits an inner receiving chamber (14), side conveyors (6) for the cyclical forward movement of a net tubing supply (7) provided on each conveyor pipe (2, 3) as packaging material, a closing and separating device (9) in the region of the outlet end of the conveyor pipe (2, 3) that is in the operating position for the closing and severing of a filled net tubing section (21). To increase the performance of the apparatus, both conveyor pipes (2, 3) are, in accordance with the invention, arranged horizontally, the conveyor pipe that is operating at the time is assigned at the inlet side and the outlet side a bin-forming pivoted flap arrangement (4, 5) for the fill goods portion in question, the closing and separating device (9) exhibits grippers (39) that circulate in a cyclical, unidirectional manner for the bringing in and severing of a filled net tubing section (21) in the closing and separating position, and is provided with a device (45) for the application of a price indication label to the filled net tubing section.

11 Claims, 3 Drawing Sheets

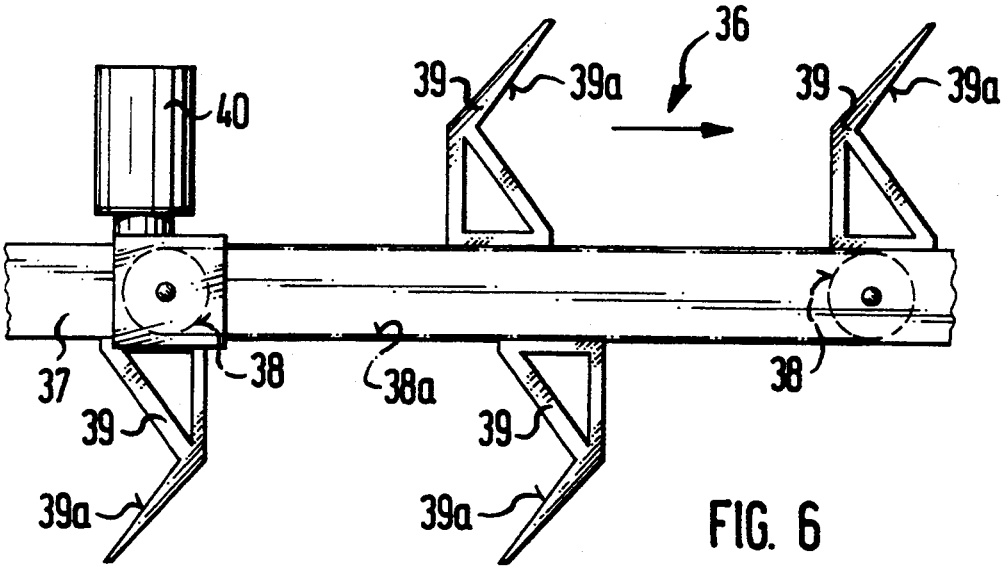
FIG. 6
FIG. 9
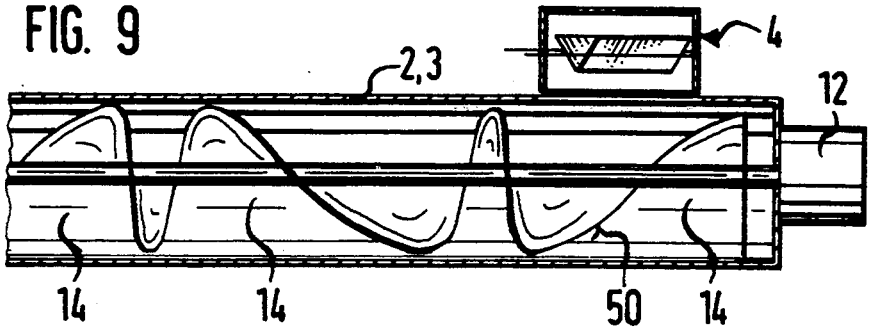
FIG. 7
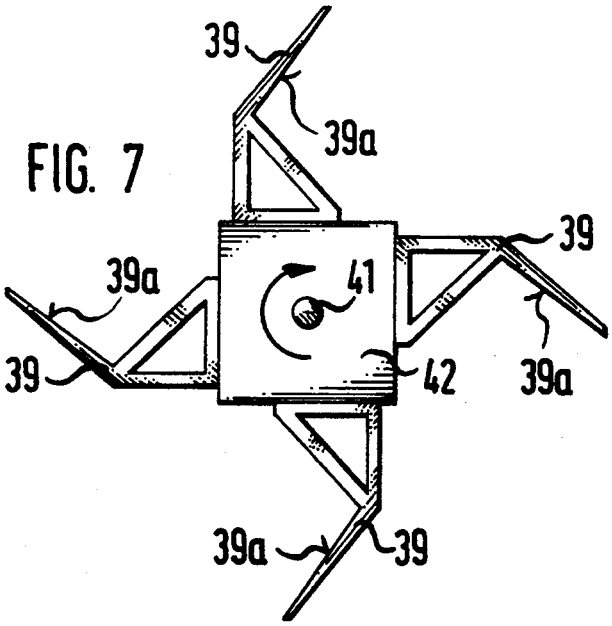
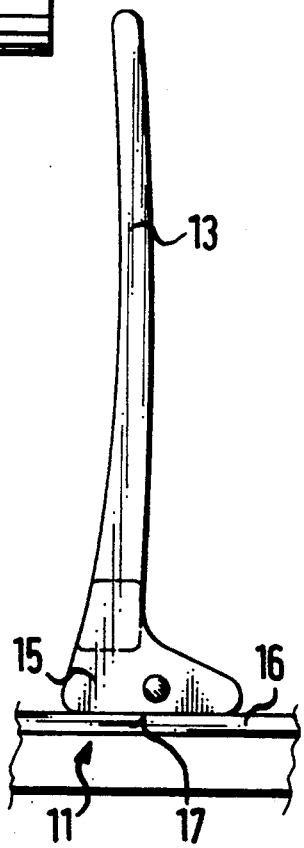
FIG. 8

APPARATUS FOR PORTION PACKING OF LUMPY GOODS

FIELD OF THE INVENTION

The invention is based on an apparatus for the portion packing of lumpy goods, particularly of impact-sensitive fruit and vegetables, foodstuffs, and confectioneries.

BACKGROUND OF THE INVENTION

An apparatus of that type is described in DE-A 31 02 552. This known apparatus exhibits a conveyor pipe that is fastened to a machine frame and one inlet and one outlet at its end regions, whereby inside the conveyor pipe a conveyor device is provided that operates in a cyclical fashion and exhibits receiving chambers for the portioned fill goods. This conveyor device includes an endless conveyor belt with flaps that are positioned at a distance from one another, that form the receiving chambers, and that stand upright on the upper conveying run of the conveyor belt, while being folded away during their return movement along the lower run. Outside and to the sides of the conveyor pipe, two side conveyors are provided for the cyclical forward movement of a supply of net tubing that is provided on the conveyor pipe as packaging material for the portion-packed fill goods. The side conveyors move the supply of net tubing forward by one packaging length each time. In addition, a closing and separating device is provided in the outlet region of the conveyor pipe for the closing and severing of a section of net tubing that is filled with the portion of fill goods. The closing of a filled section of net tubing takes place by means of two clamps that are placed at a slight distance from each other, and the severing of the filled section of net tubing takes place by means of a cut between these two closed clamps. At the same time, the lower end of the next section of net tubing to be filled is closed off by the upper clamp.

A high hourly filling rate cannot be achieved with an apparatus of this type, when, in particular, impact-sensitive fill goods are to be portion filled without points of impact and other damage that can be attributed to the impacting of the pieces of the fill goods on one another. In addition, the expenditure of time for the handling of the fill goods portion that comes out of the outlet side of the conveyor tube is relatively high as well, so that due to the filling, closing, and severing processes that are going on, a considerable share of time is used for the packaging of portioned fill goods.

The task of the invention consists of improving an apparatus of the type mentioned in the introduction in such a way that a considerably increased packaging rate is achieved at the same time as a more gentle handling of the portioned packaged goods and/or fill goods.

With the machine in accordance with the invention, a substantially increased packaging rate is achieved, whereby the fill goods are at the same time handled very gently. Such a machine or apparatus is especially well-suited for impact-sensitive goods, especially fruit and vegetables, tropical fruits, other impact-sensitive foodstuffs such as, for example, potatoes, and also for confectioneries. The apparatus can, of course, also be applied to fill goods to be packaged for which the sensitivity to impact is not as critical. One important reason for the increased filling and packaging rate (high number of packages) of the apparatus is due to the fact that it can be driven at a considerably increased speed, whereby the fall height of the fill goods both on the inlet side as well as on the outlet side of the conveyor pipe, which operates level, are kept very slight. The rapidity of the apparatus in accordance with the invention can in addition be attributed to the fact that processes taking place at the inlet and outlet sides of the two conveyor pipes for the conveying in and conveying out of the fill goods portions can be better matched to the device operations that are taking place during the conveying in of the fill goods portions and to the processes that are taking place in the region of the outlet side of the working conveyor pipe.

SUMMARY OF THE INVENTION

A preferred layout of the pivoted flap arrangements provided on the inlet side and outlet side of the level-operating conveyor pipe consists in the fact that the arrangements include two V-shaped opposing pivoted flaps that form a receiving bin for the portioned fill goods; these flaps can be driven in a rotary movement of such a type that they form a temporary lower discharge opening. In conjunction with this, the two pivoted flaps can be placed within a housing that is open at the top and bottom. The pivoted flap arrangement on the inlet side can already be refilled once it has discharged its fill loading into the filling chamber of the conveyor device that lies below, but this chamber has not yet been moved forward by one working cycle. In conjunction with this, the two pivoted flaps are preferably driven unidirectionally, and are laid out in such a way that their axis of rotation runs through their longitudinal center. As a result of this, the two pivoted flaps only have to rotate through 180° in order to form and to close the discharge opening mentioned above. An additional reason for the increased packaging rate of the apparatus in accordance with the invention consists in the fact that it exhibits a device for the attachment of a price indication label at the clamp that closes the top of the filled net tubing section. In this way, the attachment of a price indication label is also automated, and an attachment of this label afterwards, which must be carried out by hand, can be dispensed with. In conjunction with this, in a further configuration of the apparatus in accordance with the invention, the device for the attachment of a price indication label is assigned a price calculating device that works in conjunction with a weighing device of the apparatus and a printer for the printing out the calculated price for a predetermined fill goods portion on the indicating label specified for this. This makes it possible to print on the indicating label the price that is actually applicable only to the fill goods portion in question.

BRIEF DESCRIPTION OF THE DRAWINGS

The invention is described in more detail in the following by means of an implementation example that is represented in the attached drawings. The following are shown:

FIG. 6 A first form of implementation of a grasping device in top view,

FIG. 7 A second form of implementation of a grasping device in top view,

FIG. 8 One flap of a primary conveyor device in end view,

FIG. 9 An alternative primary conveyor device.

DETAILED DESCRIPTION OF PREFERRED EMBODIMENTS

Figure 1:
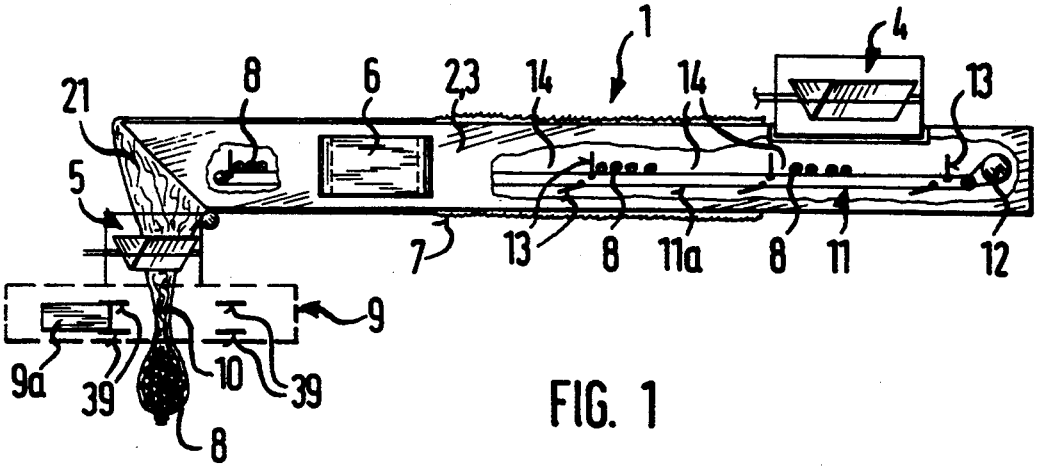
FIG. 1 A simplified side view of the implementation example.
Figure 2:
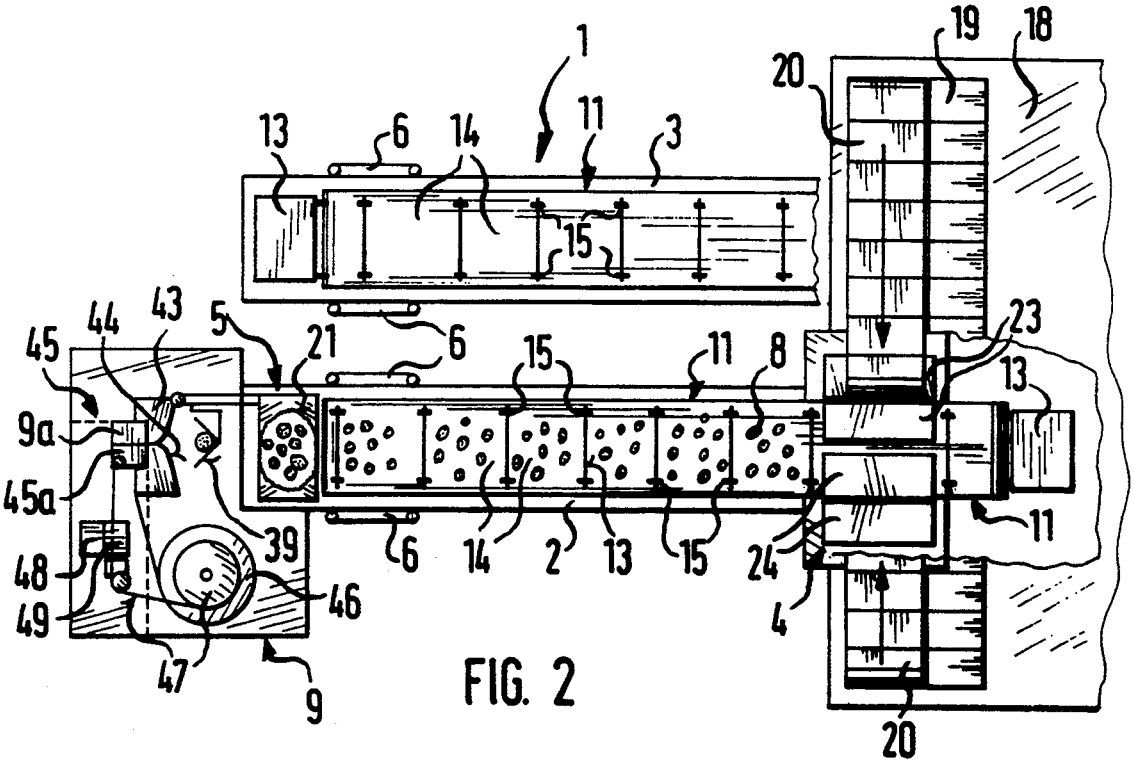
FIG. 2 A top view of the implementation example according to FIG. 1.

The apparatus for portion packing of lumpy goods, and in particular, of impact-sensitive fruit and vegetables, foodstuffs, and confectioneries or similar items, which apparatus is given the general designation 1 in FIGS. 1 and 2, consists of one or more, preferably two, horizontal conveyor pipes 2 and 3 that are mounted on a machine frame (not shown), of a pivoted flap arrangement 4 that is provided in the inlet region of conveyor pipe 2, which is already in operating position (FIG. 2), of an additional pivoted flap arrangement 5 that is provided in the outlet region of conveyor pipe 2, of side conveyors 6 that are placed on the outside of each conveyor pipe and that are in the form of endless belt conveyor devices for the cyclical forward movement of a net tubing supply 7 that is provided on each conveyor pipe 2, 3 as packaging material for the fill goods portions 8 that are to be filled, and of a closing and separating device, generally given the designation 9, for the closing and severing of a net tubing section 10 that is filled with a portion of the fill goods, whereby this device is provided in the outlet region of the conveyor pipe that is already in an operating position, and specifically, in the filling direction behind the other pivoted flap arrangement 5. In FIG. 1, conveyor pipe 2 is also drawn partly in cutaway in order to show the inner construction of the conveyor pipe. In order to provide a better view, the net tubing supply 7 is not shown on the conveyor pipes 2 and 3 in FIG. 2.

In FIG. 2, conveyor pipe 2 is shown in operating position, while conveyor pipe 3 is located in a resting position alongside of conveyor pipe 2. It is known that conveyor pipe 3 in this position is provided with a net tubing supply 7 while conveyor pipe 2 is operating. When the net tubing supply on conveyor pipe 2 is used up, conveyor pipe 3 is moved horizontally into operating position. Conveyor pipe 2 is then provided with a new net tubing supply. In the present case, the mounting of a net tubing supply likewise takes place with the aid of the side conveyors 6.

The interior space of the conveyor pipes 2 and 3 is provided in a known manner with a primary conveyor device that is driven by a motor 12. This conveyor device can consist of an endless belt that is provided at intervals with movable flaps 13, between which the chambers 14 are formed in which fill goods portions 8 are located. In principle, the conveyor device 11 extends over the entire length of each conveyor pipe. The ability of the flaps 13 to move consists in the fact that these can be raised, as is shown in FIG. 1, in order to form the chambers 14. The flaps 13 thus stand upright on the upper conveying run of the conveyor belt 11*a*. They are folded down on the returning lower run in order to save space.

As can be seen from FIG. 8, the flaps 13 of the conveyor device 11 are held in an upright position in a simple way. For this purpose, they are provided at both lower ends with sliding blocks 15, each of which slides along a guideway 16, for example, in the form of a guide rail in the region of the upper run of the conveyor belt 11*a* of the conveyor device 11. To do this, the sliding blocks possess a long lower standing surface 17 with which they move forward in a cyclical manner on the associated guide rail 16.

In an alternative form of implementation, in place of the endless conveyor device 11 in each of the conveyor pipes 2, 3, a worm conveyor 50 can also be used, with which the chambers 14 for the portioned fill goods 8 are formed by a larger worm pitch, as can be seen clearly in FIG. 9.

At the entry side of the conveyor pipes 2, 3, along with the usual supply containers (not shown) for the fill goods, there is also a weighing device 18 with several weighing containers 19 in order to weigh the individual fill goods portions. From the weighing containers 19, the weighed fill goods portions make their way to forwarding conveyors 20 that bring the fill goods portions one after the other to the inlet-side pivoted flap arrangement 4. From the pivoted flap arrangement 4, the fill goods portions in question are put into an empty chamber 14 of the conveyor device underneath the pivoted flap arrangement, after which the conveyor device is moved forward by one cycle, that is, by one chamber 14.

When the conveyor device 11 moves forward by one cycle, the front fill goods portion 8 falls from the conveyor belt 11*a* into a net tubing section 21 that is hanging from the outlet end of the working conveyor pipe 2 or 3. As this takes place, the outlet-side pivoted flap arrangement 5 is at first closed, as FIG. 1 shows, so that the fill goods portion 8 is first collected in it. In conjunction with this, the pivoted flap arrangement 5 opens, so that the fill goods portion then falls into the lower end region of the net tubing section 21, which is naturally closed at the bottom with a clamp in the usual manner (FIG. 1).

Figure 3:
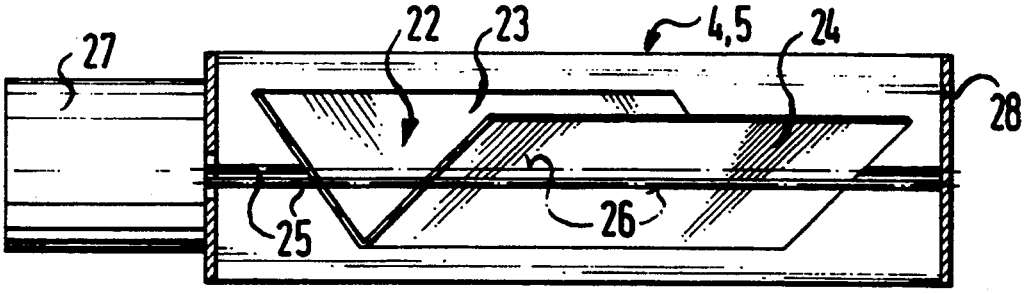
FIG. 3 A first form of implementation of a pivoting flap arrangement.

The first form of implementation of a pivoted flap arrangement 4 or 5 shown that is shown in FIG. 3 consists of two V-shaped opposing pivoted flaps 23 and 24 that form a receiving bin 22 for the portioned fill goods. Preferably, these pivoted flaps are provided with axle shafts 25 that are fastened to the pivoted flaps in such a way that the axes of rotation 26 of the pivoted flaps extend through the longitudinal center of the pivoted flaps. Because of this design, the pivoted flaps only need to be turned 180° in one direction in order to form a new receiving bin 22. During this turning through 180°, a lower discharge opening for the fill goods portion is temporarily formed in the lower region of the pivoted flaps. The unidirectional rotary movement of the pivoted flaps 23, 24 is brought about by a motor 27. This motor is attached to a housing 28 for the pivoted flaps, whereby this housing is open at the top and bottom. At least the pivoted flap arrangement 4 that is located at the inlet side of the conveyor pipe 2, 3 that is located in operating position is provided with a housing. If it is so desired, the other pivoted flap arrangement, which is located at the outlet side of the operating conveyor pipe, can also be provided with a housing. As an alternative, with the pivoted flap arrangement shown in FIG. 3, it is possible that the pivoted flaps 23, 24 can also be driven in a back and forth movement in order to open and then close at the bottom the receiving bin 23 that they form.

Figure 4:
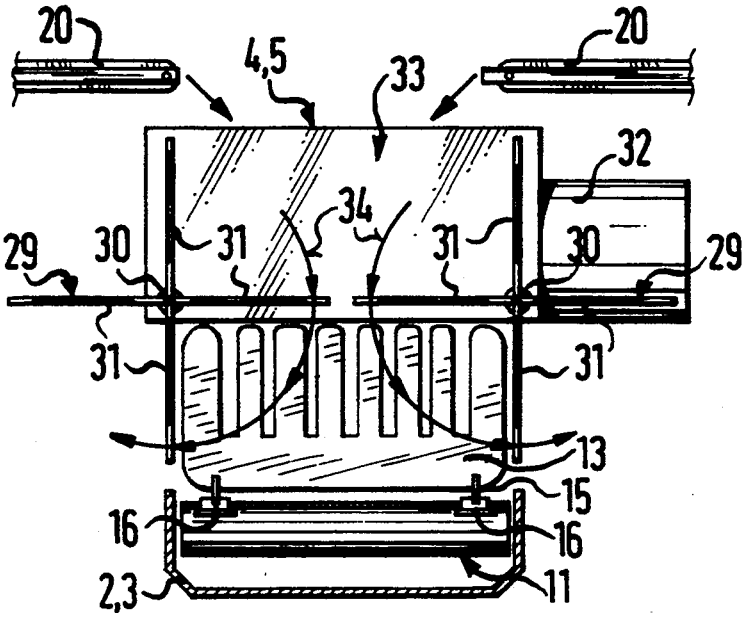
FIG. 4 A second form of implementation of a pivoting flap arrangement.
Figure 5:
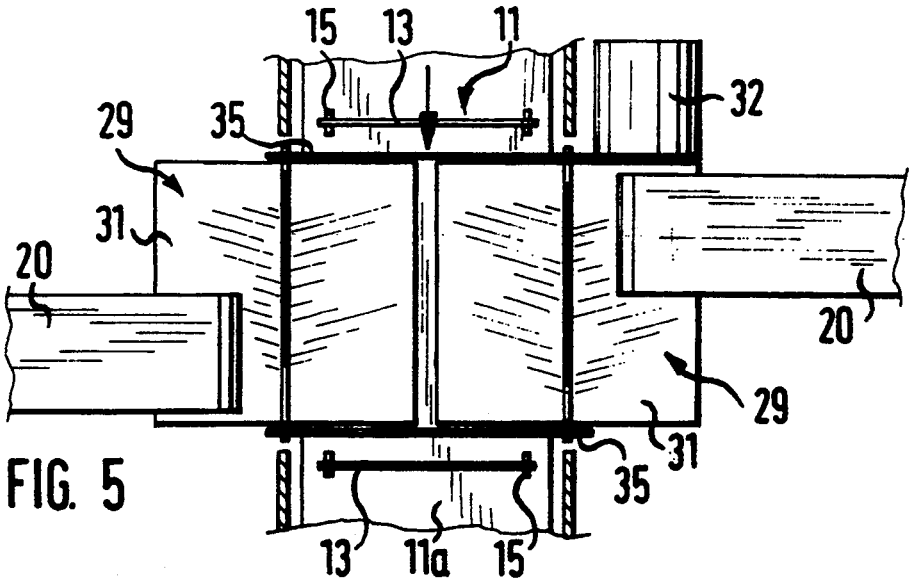
FIG. 5 A top view of the pivoting flap arrangement according to FIG. 4.

In FIGS. 4 and 5 an alterative form of implementation for the pivoted flap arrangements 4 and 5 is shown. Each pivoted flap arrangement includes two opposing pivoted flap stars 29, whereby each rotatable star 4 exhibits pivoted flaps 31 attached at right angles to each other on an axle shaft 30. Each star flap pair is driven from a common motor 32. As can be clearly seen in FIG. 4, a common receiving bin 33 is formed by two neighboring pivoted flaps 31 of each flap star 29 for the fill goods portions to be deposited one after the other by the forwarding conveyors 20. When the particular fill goods portion deposited in bin 33 is to be deposited towards the bottom onto the conveyor device 11, star flap pair 29 is moved forward intermittently by the common motor 32 in accordance with the arrows 34, whereby the particular fill goods portion falls onto the conveyor device 11 of the conveyor pipe 2, 3 in question. The star flap pair 29 is driven only unidirectionally in this case as well. One can also proceed in this case in such a way that only the inlet-side pivoted flap arrangement 4 in accordance with this type of construction is provided with a housing 35 that is open at the top and bottom, whereby such a housing in its practical implementation consists in principle only of two side walls that lie opposite the ends of the stars.

A first form of implementation of a grasping device for the closing and separating device 9 is shown in FIG. 6. This grasping device consists of an endless conveyor device 36, which is attached to a frame 37. To this frame are mounted two deflection wheels 38, which are mounted on bearings in a rotatable manner and are joined by means of an endless link conveyor **38*a* with several grippers 39 that are separated from each other in the direction of movement. The endless link conveyor 38*a* is driven by a motor 40 in a cyclical manner so that the grippers 39 also circulate in a cyclical manner. All grippers 39 are formed into a V-shape at their fronts 39*a* so that the net tube section that is grasped by them finds itself gathered together in the apex of the V-form, so that the net tubing section that is at this point can be securely closed in the usual manner by means of the device 9**.

The alternative form of implementation of a grasping device that is shown in FIG. 7 is formed in a star shape. It consists of a retaining device 42 that can be driven cyclically around a common axis of rotation 41 by a motor that is not shown, and to which, for example, four grippers 39 are attached at equal distances from each other in a circumferential direction. These grippers also exhibit a V-shaped front.

The closing and separating device 9 exhibits a fixed guide plate 43 (FIG. 2) that possesses a V-shaped intake guide 44, so that the net tubing section 21 that is brought together by the grippers 39 is securely positioned in the apex of the intake guide 44 at its point of closing and separating for further handling at this point.

As can be seen from FIG. 2, in the region of the closing and separating device 9 there is also a device 45 for the application of a common, oblong price indication label (not shown) to the filled net tubing section that is to be severed. Since the closing and separating procedures for closing and severing a filled net tubing section are known, let it just be briefly mentioned that this is carried out by a clamp closing device **9*a* using two clamps that are applied at a distance from one another and one over the other in the brought together region of the net tubing section 21. As this is done, the lower clamp forms the upper closing of the filled net tubing section and the upper clamp forms the lower closing of the upper net tubing section that is to be filled in conjunction with this. In the present case, the price indication label is attached to the upper clamp of the net tubing section that has already been filled. For this purpose, device 9 exhibits a supply roll 46 on which a small metal band or wire is coiled up for forming the clamps that were mentioned above. This band is then fed using the usual technology to the clamp closing unit 9*a* at the point of closing and separation. An additional supply roll 47 is provided on which the label band is coiled up. The device 45 for applying the price indication label includes, along with the insertion unit 45*a* that guides the completed label into the clamping area and that is integrated into the clamp closing unit 9*a*, a price calculation device 48, which works together with the weighing device 18, and a printer 49 for printing out the calculated price for the specific preselected fill goods portion 8. By means of an appropriate electrical circuit device and in adaptation to the specific receiving chamber 14 of the conveyor device 11 of the conveyor pipe 2, 3** that is already operating, the associated price is calculated on the basis of the actual weight of the fill goods portion in question, and printed on a label which is then applied to the correct net tubing section, that is, at its upper closing clamp, once the fill goods portion in question has been filled into the correct net tubing section.

I claim:

1. Apparatus for the portion packing of lumpy goods, particularly of impact-sensitive fruit, vegetables, foodstuffs, and confectioneries, comprising two conveyor pipes (2, 3) horizontally arranged on a machine frame, each pipe having an inlet and an outlet in its end regions, said pipes being cyclable between operating and standby positions and each having an inner conveyor device (11) with receiving chambers (14) for the portion goods (8), side conveyors (6) arranged on an outer side of each conveyor pipe (2, 3) for cyclical movement of a net tubing supply (7) provided on each of the conveyor pipes, a closing and separating device (9) provided in the outlet end region of whichever conveyor pipe (2, 3) is in an operating position for closing and severing of a net tubing section (21) that is filled with portion goods, bin-forming pivoted flap arrangements (4, 5) arranged at the inlet and outlet of whichever conveyor pipe (2, 3) is in an operating position for receiving and delivering of portion goods (8) into or from the conveyor pipe, the closing and separating device (9) having grippers (39) which are driven in a cyclical, unidirectional circulating manner and which are separated from each other in the direction of circulation, for bringing in and severing of a filled net tubing section (21), and a device (45) for application of an indication label to a closed top of the filled net tubing section (21).

2. Apparatus in accordance with claim 1, wherein each bin-forming pivoted flap arrangement (4, 5) includes two V-shaped opposing pivoted flaps (23, 24) that form a receiving bin (22) for the portion goods and that are driven in a rotating movement for forming a temporary lower discharge opening for the portion goods.

3. Apparatus in accordance with claim 1, wherein each bin-forming pivoted flap arrangement (4, 5) comprises a pair (29) of flap reconstructions (31), shaped in cross-section in the form of a star and driven in an intermittent unidirectional manner.

4. Apparatus in accordance with claim 1, wherein at least the pivoted flap arrangement (4) provided on the inlet side is arranged in a housing (28, 35) that is open at its top and bottom.

5. Apparatus in accordance with claim 1, wherein the grippers (39) are mounted on a conveyor run **(38*a*) of an endless conveyor device (36)**.

6. Apparatus in accordance with claim 1, wherein the grippers (39) are mounted on a retaining device (42) driven around a common axis of rotation (41).

7. Apparatus in accordance with claim 1, wherein the grippers (39) have a V-shaped front **(39*a*)**.

8. Apparatus in accordance with claim 1, wherein the conveyor device (11) in each conveyor pipe (2, 3) comprises a conveyor belt **(11*a*) with chamber-forming flaps (13) that can be folded down and positioned upright, the flaps that form the chambers (14) being provided with sliding blocks (15) with standing surfaces (17) that slide along a guideway (16) provided in a region of an upper run of conveyor belt (11*a*) to hold the flaps (13) standing perpendicular to the conveyor belt during cyclical forward movement of portion goods (8) received in the chambers (14)** of the conveyor belt.

9. Apparatus in accordance with claim 1, wherein each side conveyor (6) of each conveyor pipe (2, 3) comprises one endless conveyor belt device each.

10. Apparatus in accordance with claim 1, wherein the conveyor device (11) in each conveyor pipe (2, 3) comprises a worm conveyor (50) in which chambers (14) for the portion goods (8) are formed by a larger worm pitch.

11. Apparatus in accordance with claim 1, further comprising a weighing device (18) for weighing of portion goods, and the device (45) for application of an indication label is provided with a price calculation device (48) that cooperates with the weighing device (18) and with a printer (49) for printing out a calculated price for specific preselected portion goods (8) on the indicating label specified for the goods.

* * * * *